US012454803B2

(12) United States Patent
Spalder et al.

(10) Patent No.: US 12,454,803 B2
(45) Date of Patent: Oct. 28, 2025

(54) SUBSEA WELLHEAD FOUNDATION

(71) Applicant: AKER SOLUTIONS SUBSEA AS, Lysaker (NO)

(72) Inventors: Brynjulf Spalder, Asker (NO); Rolf Barfod Schueller, Droebak (NO)

(73) Assignee: ONESUBSEA AS, Lysaker (NO)

( * ) Notice: Subject to any disclaimer, the term of this patent is extended or adjusted under 35 U.S.C. 154(b) by 118 days.

(21) Appl. No.: 18/567,369

(22) PCT Filed: Jun. 7, 2022

(86) PCT No.: PCT/NO2022/050128

§ 371 (c)(1),
(2) Date: Dec. 6, 2023

(87) PCT Pub. No.: WO2022/260529

PCT Pub. Date: Dec. 15, 2022

(65) Prior Publication Data

US 2024/0271383 A1 Aug. 15, 2024

(30) Foreign Application Priority Data

Jun. 8, 2021 (NO) ..... 20210741

(51) Int. Cl.
*E02D 27/52* (2006.01)
*E21B 33/035* (2006.01)

(52) U.S. Cl.
CPC ..... *E02D 27/525* (2013.01); *E21B 33/035* (2013.01); *E02D 2250/0053* (2013.01)

(58) Field of Classification Search
CPC ..... E02D 27/525; E02D 2250/0053; E21B 33/035
See application file for complete search history.

(56) References Cited

U.S. PATENT DOCUMENTS

| | | | | |
|---|---|---|---|---|
| 4,446,932 | A | 5/1984 | Hipp | |
| 4,880,067 | A | 11/1989 | Jelsma | |
| 10,648,248 | B2 | 5/2020 | Strand et al. | |
| 2015/0372470 | A1 | 12/2015 | Strand | |
| 2018/0355699 | A1* | 12/2018 | Mathis | E02D 27/525 |

FOREIGN PATENT DOCUMENTS

| | | | |
|---|---|---|---|
| GB | 2 170 842 | A | 8/1986 |
| WO | WO 2017/091084 | A1 | 6/2017 |
| WO | WO 2017/179992 | A1 | 10/2017 |
| WO | WO 2021/091397 | A1 | 5/2021 |

* cited by examiner

*Primary Examiner* — Kyle Armstrong
(74) *Attorney, Agent, or Firm* — Jeffrey D. Frantz

(57) ABSTRACT

A subsea foundation for installation on a sea floor. The subsea foundation includes a receptacle which receives a wellhead housing, and a conductor pipe which is arranged to extend from the receptacle and which receives a well pipe therethrough. The conductor pipe has a first section and a second section. The first section of the conductor pipe has a first end and a second end. The first section is connected to the receptacle at the first end and is pivotably connected to the second section at the second end so that the conductor pipe has a compact configuration, in which the conductor pipe comprises a bend therein, and an extended configuration, in which the conductor pipe is substantially straight.

8 Claims, 6 Drawing Sheets

SUBSEA WELLHEAD FOUNDATION

CROSS REFERENCE TO PRIOR APPLICATIONS

This application is a U.S. National Phase application under 35 U.S.C. § 371 of International Application No. PCT/NO2022/050128, filed on Jun. 7, 2022 and which claims benefit to Norwegian Patent Application No. 20210741, filed on Jun. 8, 2021. The International Application was published in English on Dec. 15, 2022 as WO 2022/260529 A1 under PCT Article 21(2).

FIELD

The present invention relates to a subsea wellhead foundation and to methods for installing a subsea wellhead foundation, for example, for use with a petroleum well.

BACKGROUND

Wellhead systems for subsea wells are traditionally known to comprise a wellhead having a wellhead housing secured to a well casing. Wellhead systems for subsea wells also generally have a valve stack, such as a blow out preventer (hereinafter referred to as BOP) or valve tree, located permanently or temporarily on the wellhead, for example, during drilling, work-over operations and various phases of the operation. Such subsea wells can be used, for example, for petroleum exploration and/or for the injection of fluids (such as water or $CO_2$) into a subterranean reservoir, as well as for extraction/production of hydrocarbons.

Installation of such subsea wellhead systems is typically carried out by an installation vessel, such as a ship or a drilling rig. The process is demanding, with high requirements for installation accuracy while maintaining strict safety standards to avoid risk to personnel or equipment. It is commonly a requirement, for example, that a foundation for supporting the subsea wellhead be installed substantially vertically within strict limits for permitted deviation from the vertical (typically a few degrees). Vessels used for such offshore installation processes are typically highly specialized units which are costly to operate, with efficiency also being a key concern for operators.

Publications which may be useful to understand the field of technology include WO 2017/179992 A2, WO 2017/091084 A1 and WO 2021/091397 A1.

There is a continuous need for improved technology for such wellhead foundations.

SUMMARY

An aspect of the present invention is to provide improvements in technology for such wellhead foundations, or at least alternatives to known solutions and techniques. An aspect of the present invention is in particular to mitigate, alleviate or eliminate one or more of the above-identified deficiencies and disadvantages in the prior art.

In an embodiment, the present invention provides a subsea foundation for installation on a sea floor. The subsea foundation includes a receptacle which is configured to receive a wellhead housing, and a conductor pipe which is arranged to extend from the receptacle and which is configured to receive a well pipe therethrough. The conductor pipe comprises a first section and a second section. The first section comprises a first end and a second end. The first section is connected to the receptacle at the first end and is pivotably connected to the second section at the second end so that the conductor pipe is configurable between a compact configuration, in which the conductor pipe comprises a bend therein, and an extended configuration, in which the conductor pipe is substantially straight.

BRIEF DESCRIPTION OF THE DRAWINGS

The present invention is described in greater detail below on the basis of embodiments and of the drawings in which.

SUMMARY

Figure 1:
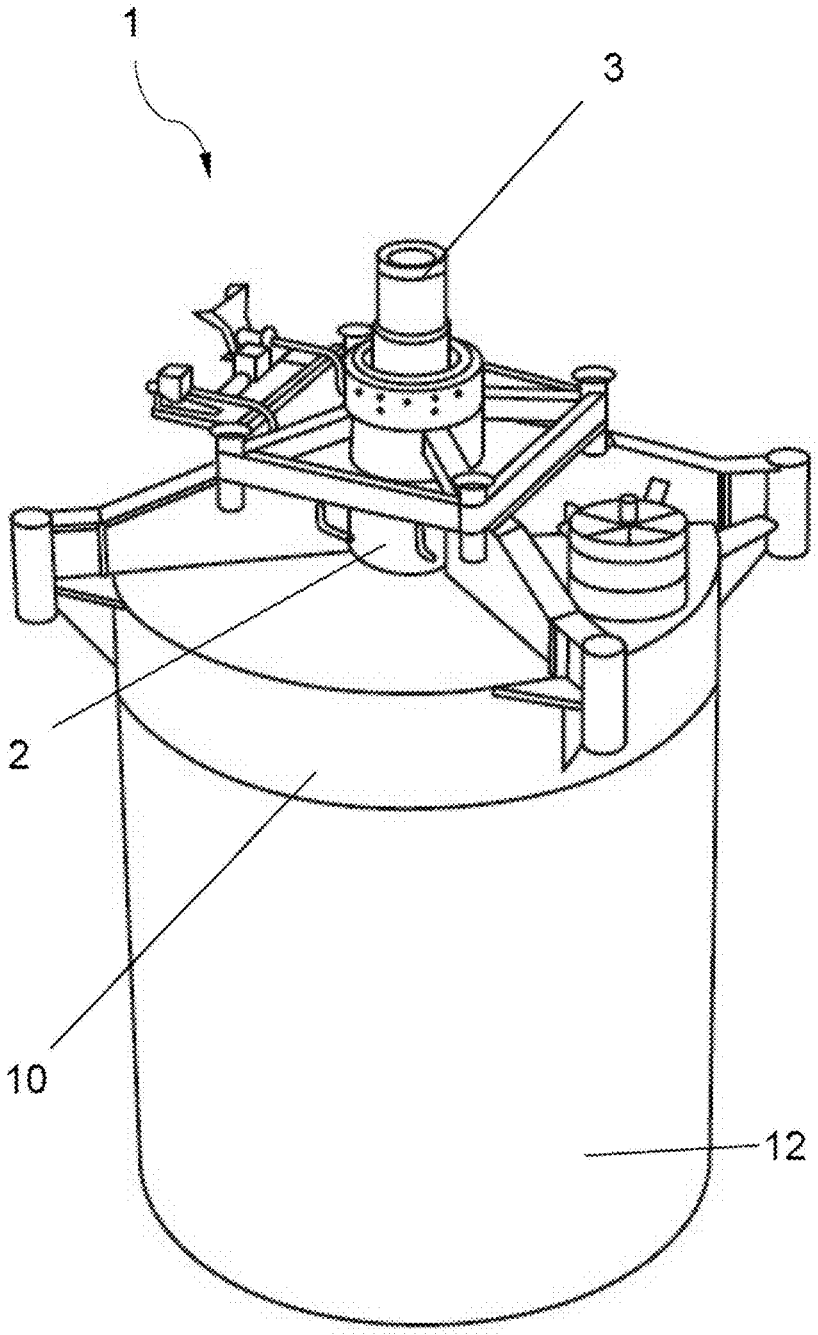
FIG. 1 is a schematic view of a subsea wellhead assembly.

A first embodiment of the present invention provides a subsea foundation for installation on a sea floor, the subsea foundation comprising: a receptacle configured for receiving a wellhead housing, a conductor pipe extending from the receptacle and configured for receiving a well pipe therethrough, the conductor pipe comprising a first section being connected to the receptacle at one end thereof and being pivotably connected to a second section at a second end thereof, so that the connector pipe is configurable between a compact configuration in which the conductor pipe comprises a bend therein, and an extended configuration, in which the conductor pipe is substantially straight.

A second embodiment of the present invention provides that the subsea foundation may comprise a suction anchor base.

A third embodiment of the present invention provides that the suction anchor base may be substantially cylindrical, and the first section of the conductor pipe may be arranged concentrically inside the suction anchor base.

A fourth embodiment of the present invention provides that the first section of the conductor pipe may be fully located within the suction anchor base.

A fifth embodiment of the present invention provides that the suction anchor base may be cylindrical, and the second section of the conductor pipe may be shorter than the radius of the suction anchor base so that in the compact configuration, the second section of the conductor pipe may be located inside the suction anchor base.

A sixth embodiment of the present invention provides that the second section of the conductor pipe may be longer than the radius of the suction anchor base, and that the suction anchor base may comprise a recess therein for locating the second section with the conductor pipe in the compact configuration.

A seventh embodiment of the present invention provides that, in the extended configuration, the conductor pipe protrudes outside the suction anchor base.

An eighth embodiment of the present invention provides that the subsea foundation may comprise a hinge joint between the first and second sections of the conductor pipe, thereby enabling the pivotal connection therebetween.

A ninth embodiment of the present invention provides that the hinge joint may comprise a disengaged configuration in which an end of the second section may be held distal to the second end of the first section where pivotal movement therebetween may be enabled, and an engaged configuration in which the second end of the first section may be engaged with an end of the second section and the conductor pipe may be in the extended configuration.

These and other embodiments will become clear from the following description of illustrative embodiments, which are provided as non-restrictive examples, under reference to the attached drawings.

DETAILED DESCRIPTION

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the present invention. The terms are used for the reader's convenience only and shall not be limiting.

FIG. 1 shows a subsea foundation 1 for installation of the sea floor (not illustrated). The subsea foundation 1 may be described as a suction anchor foundation. The subsea foundation 1 of FIG. 1 is illustrated in a configuration similar to that in which it may be installed, i.e., FIG. 1 illustrates the subsea foundation 1 in an upright configuration.

The subsea foundation 1 comprises a receptacle 2 which may be used to receive a wellhead housing 3. The receptacle 2 is located on an upper component 10 of the subsea foundation 1, which in this case is in the form of a circular plate or platform. The receptacle 2 defines an aperture therethrough for the receipt of a wellhead housing 3. A lower component 12 extends from the upper component 10, the lower component 12 in this example being in the form of a hollow cylinder, and the upper and lower components 10, 12 together defining an anchor recess. The lower component 12 may be considered to be a suction anchor base. The upper component 10 may also comprise a valve that may be used to operate the suction anchor by permitting water to be removed from the anchor recess, and thereby anchoring the subsea foundation 1 on the seabed via suction. The upper component 10 may additionally comprise stiffening and/or reinforcement members, as is the case in FIG. 1, as well as connection points for various equipment.

Figure 2:
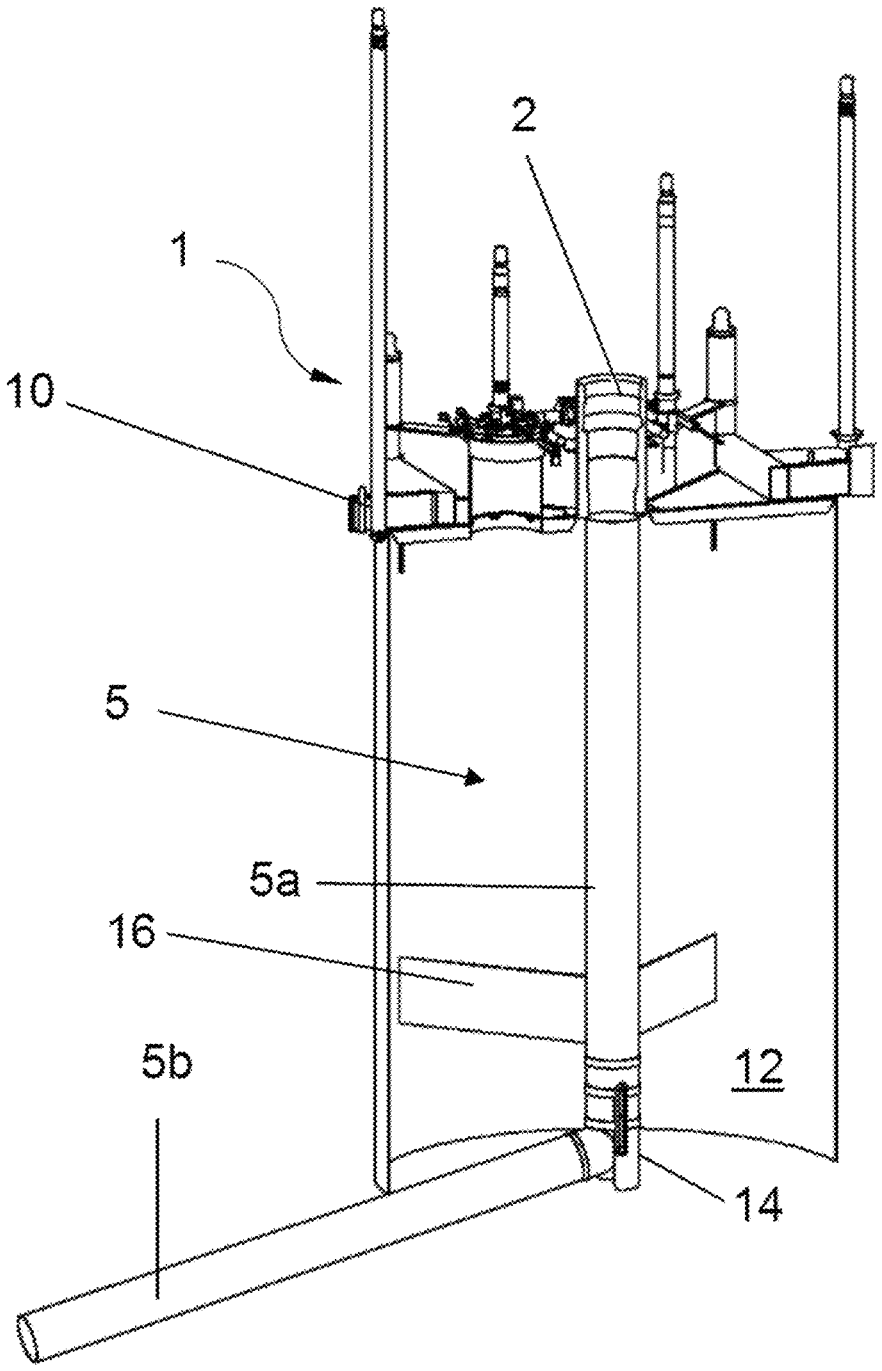
FIG. 2 illustrates a perspective cross-sectional view of a subsea well assembly.
Figure 3:
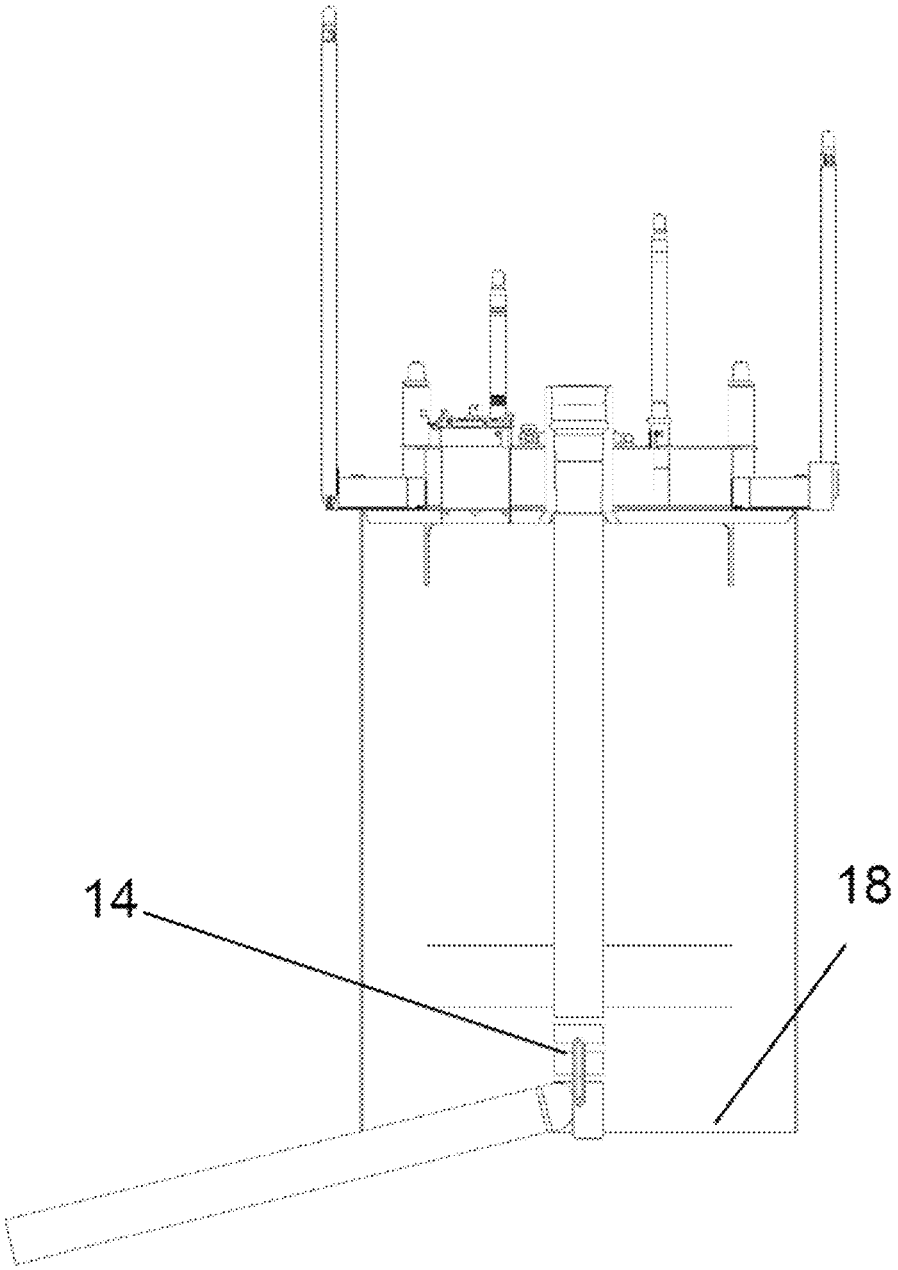
FIG. 3 illustrates an elevation cross-sectional view of a subsea well assembly.

The subsea foundation 1 is illustrated in cross-section in FIGS. 2 and 3. FIG. 2 illustrates a perspective cross-section, while FIG. 3 illustrates an elevation cross-sectional view. From FIGS. 2 and 3, it can be seen that the lower component 12 is a hollow cylinder, and may therefore be considered to be in the form of a skirt.

As previously indicated, the receptacle 2 defines an aperture in the upper component 10, and may be located concentrically with the upper component 10 and/or the lower component 12. From the upper component 10, in a downwards direction, extends a conductor pipe 5, comprising a first section 5*a* and a second section 5*b*. The conductor pipe 5 may act as a guide for, for example, any pipes, casings, tubings or the like that extend from the wellhead, e.g., into a well. The conductor pipe 5 extends within the lower component 12 (e.g., extends within the skirt) and may be either partially or fully located within anchor recess defined by the upper and lower components 10, 12 depending on the geometry of the conductor pipe 5 and the upper and lower components 10, 12.

As illustrated in FIGS. 2 and 3, the first section 5*a* is connected (e.g., rigidly connected) to the receptacle 2 of the upper component 10 at one end thereof, and at a second end thereof comprises a pivotal connection to the second section 5*b*. To facilitate the connection between the first section 5*a* and the upper component 10, the lower component 12 may comprise a support member 16, such as a bracket or a tie, which connects the first section 5*a* to the lower component 12. The pivotal connection may be any connection that enables a pivotal movement between the first and second sections 5*a*, 5*b*. In this example, the first and second sections 5*a*, 5*b* are connected by a hinge joint 14 which will be described in further detail in relation to the following drawings.

In FIGS. 2 and 3, the conductor pipe 5 is illustrated in a compact configuration in which the conductor pipe 5 comprises a bend therein. While the first section 5*a* is connected (e.g., rigidly connected) to the upper component 10 so that a relative movement therebetween is not expected, the pivotal connection enables a relative movement of the second section 5*b* and of both the first section 5*a* and the upper and lower components 10, 12. The pivotal connection between the first section 5*a* and the second section 5*b* therefore enables the conductor pipe 5 to be configured between the compact configuration as shown in FIGS. 2 and 3, and an extended configuration as will be described in relation to the following drawings.

In this example, the second section 5*b* of the conductor pipe 5 is longer than the radius of the cylindrical lower component or skirt 12. The movement of the second section 5*b* may therefore be limited by the presence of the second section 5*b*, and in both compact and extended configurations, the conductor pipe 5 partially protrudes from the lower part 12. Although not illustrated in this example, the lower part 12 may comprise a recess for receiving the second section 5*b* of the conductor pipe 5, thereby enabling the conductor pipe 5, in the compact configuration, to be held at a level above the lower rim 18 of the second component 12. The conductor pipe 5 may additionally or alternatively comprise a third section which is pivotably connected to the second section 5*b* (e.g., via a further hinge joint similar or identical to the one described herein), and which may enable the conductor pipe 5 to be folded in a U-shape or in a J-shape inside the lower component 12, also enabling the conductor pipe 5 to be held at a level above the lower rim 18 of the lower component 12.

In some other examples, the length of the second section 5*b* may be shorter than the radius of the second part 12 (or the width, in the case where the second part may be in the form of an extruded polygon, rather than a cylinder). In such cases, it may be possible to contain both the first and second sections 5*a*, 5*b* of the conductor pipe 5 completely inside the lower component 12. It should also be noted that the length of the first section 5*a* of the conductor pipe 5 is shorter than the length of the lower component 12, and as such, in the compact configuration, the conductor pipe 5 is able to be completely contained within the lower component 12. In some other examples, the length of the first section 5*a* of the conductor pipe 5 may be longer than the length of the lower component 12, in which case, in the compact configuration, there will remain a section of the conductor pipe 5 that protrudes from the lower component 12.

With the conductor pipe 5 in the compact configuration, the subsea foundation 1 may be more easily transported that would otherwise be possible. For example, in cases where the conductor pipe 5 is able to be completely contained within the anchor recess, and/or is able to be held completely above the lower rim 18 of the second component 12, the subsea foundation 1 may be able to be transported in the upright orientation (e.g., the orientation as shown in FIG. 1). The subsea foundation 1 may, for example, be positioned on the deck of a transport vessel upright with the subsea foundation 1 resting via the lower rim 18 on the deck. In cases, such as that illustrated in FIGS. 2 and 3 and in cases where the lower component 12 comprises a recess, where the second section 5*b* is longer than the radius of the lower component 12, the laterally protruding section of the second section 5*b* may be rested, e.g., on the deck of a vessel, or may be rested on or in a support structure on a vessel, during transport. The second section 5*b* may therefore be positionable during transport so as to provide the subsea foundation 1*a* stable base 5 during transport, and additional support may be provided to the second section 5*b* where required, thereby assisting to stabilize the entire subsea foundation 1. Such a support system may not be found in other examples of subsea foundations 1.

In cases where the first section 5*a* is longer than the length of the lower component 12, or in cases where movement of the second section 5*b* is limited by the lower component 12, thereby requiring at least a part of the conductor pipe 5 to protrude from the anchor recess, the subsea foundation 1 may still be transported in the upright position, but, for example, on a raised platform. Such transport means may be preferable to, for example, having to transport the subsea foundation 1 on its side, which would then require adequate anchoring of the subsea foundation 1 to a vessel during transport, and subsequent reorientation of the subsea foundation 1 from a horizontal to a vertical position before installation.

Figure 4:
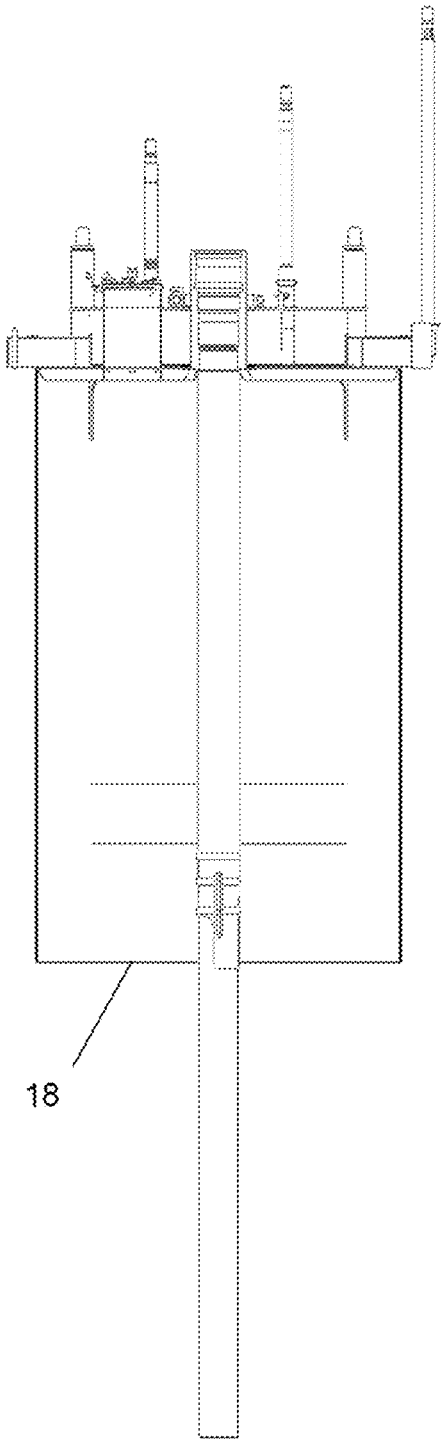
FIG. 4 illustrates the subsea foundation of FIG. 2 with a conductor pipe in an extended configuration.
Figure 5:
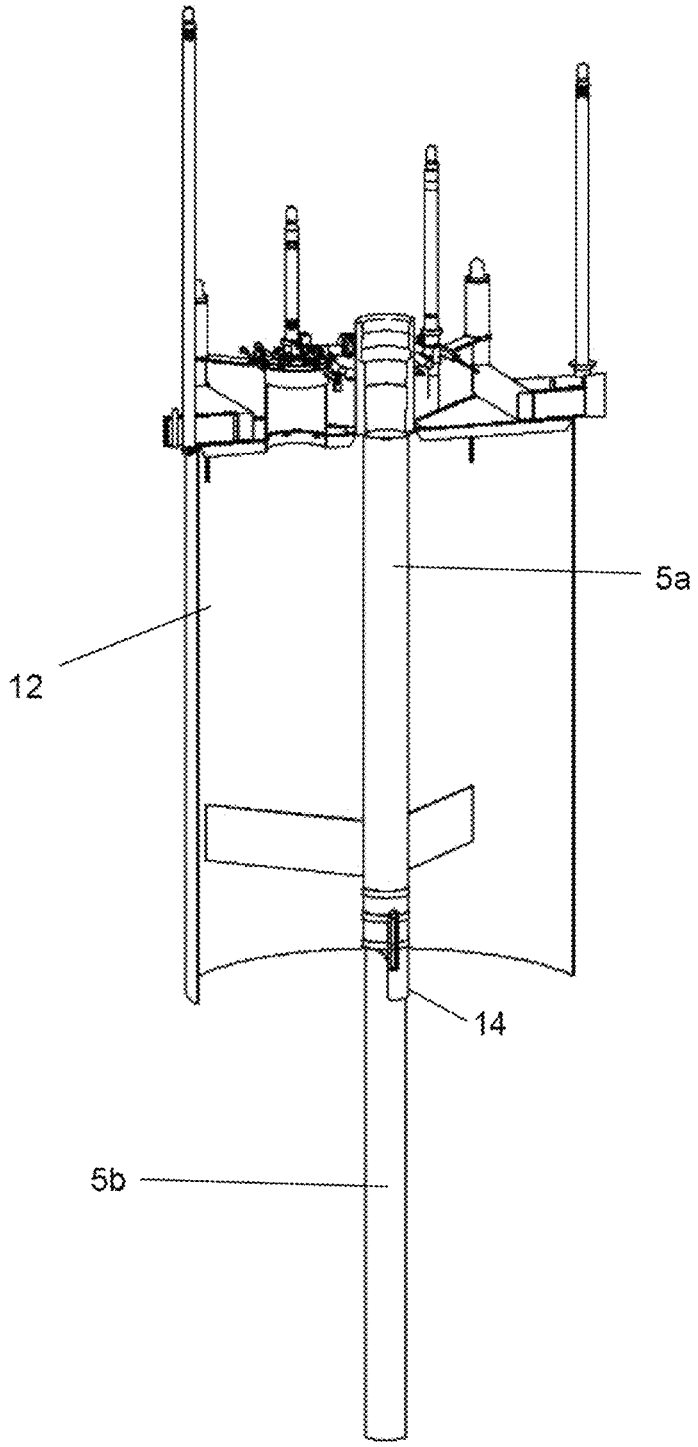
FIG. 5 illustrates the subsea foundation of FIG. 3 with the conductor pipe in the extended configuration.

FIGS. 4 and 5 illustrate the subsea foundation 1 of FIGS. 2 and 3, respectively, with the conductor pipe 5 in the extended configuration. As can be seen, in the extended configuration, the conductor pipe 5 is straight, and the first and second sections 5*a*, 5*b* are axially aligned. In the extended configuration, the conductor pipe 5 protrudes from the lower component 12, e.g., protrudes below the lower rim 18 of the lower component. The subsea foundation 1 may be installed in the expanded configuration and may be configured to the expanded configuration prior to installation, and after being suspended from a vessel, for example, by a crane. Movement of the second section 5*b* to the expanded configuration may be at least partially possible under its own weight.

Figure 6:
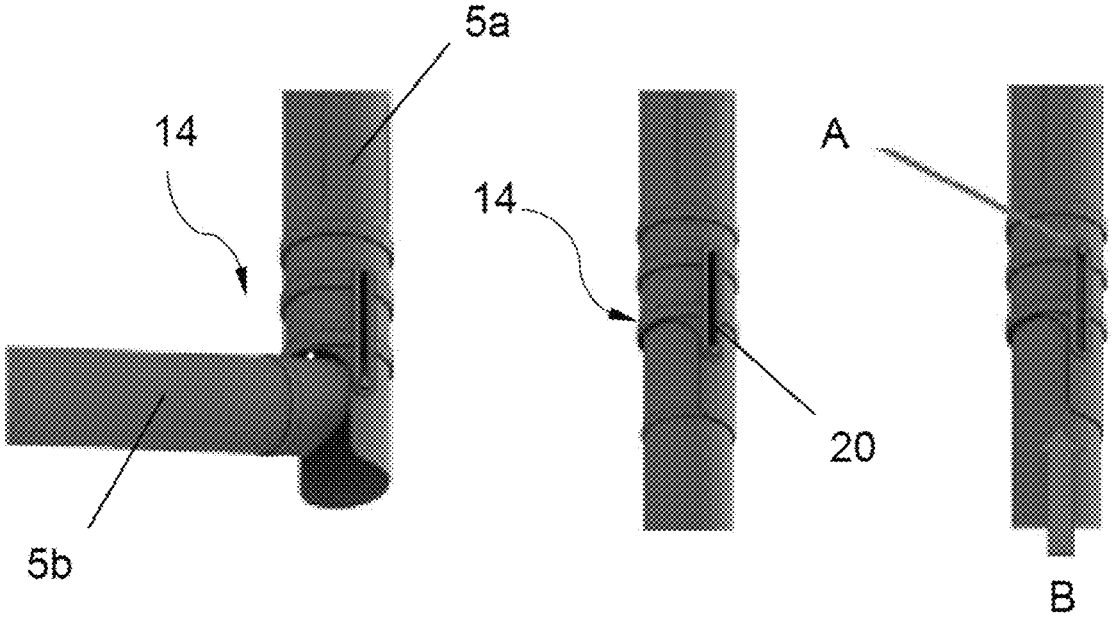
FIG. 6 illustrates the steps involved in configuring the connector pipe from a compact configuration to the extended configuration.
Figure 7:
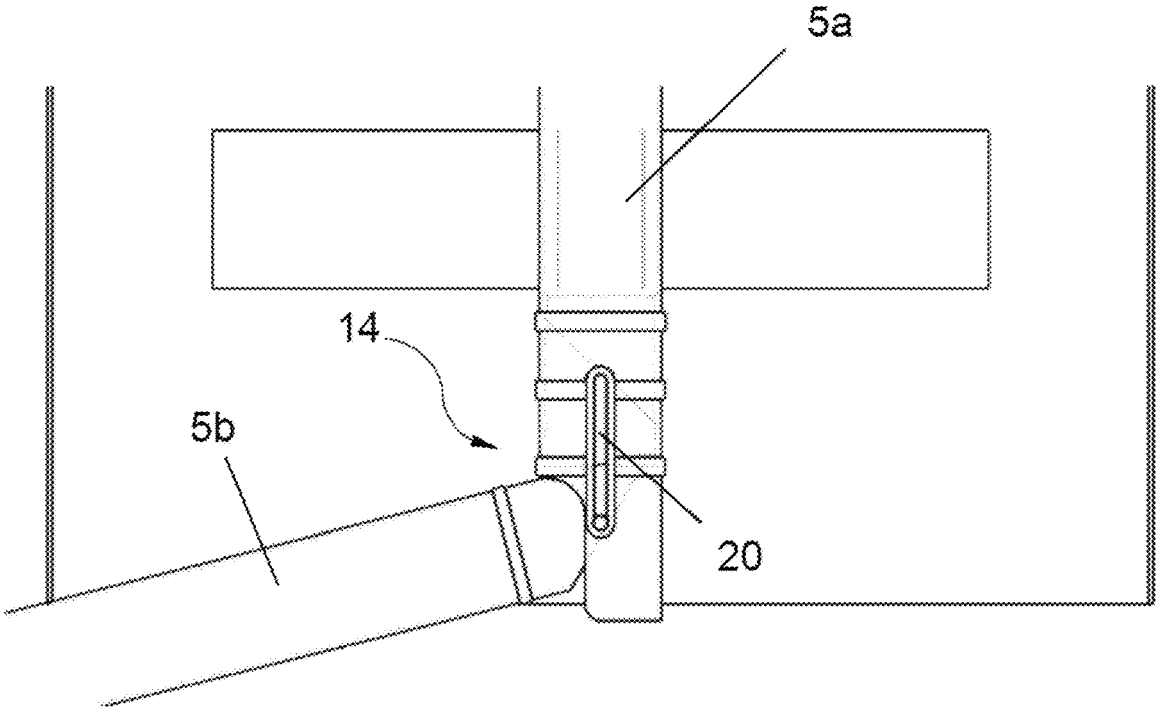
FIG. 7 illustrates further details of the hinge joint in the subsea wellhead assembly.
Figure 8:
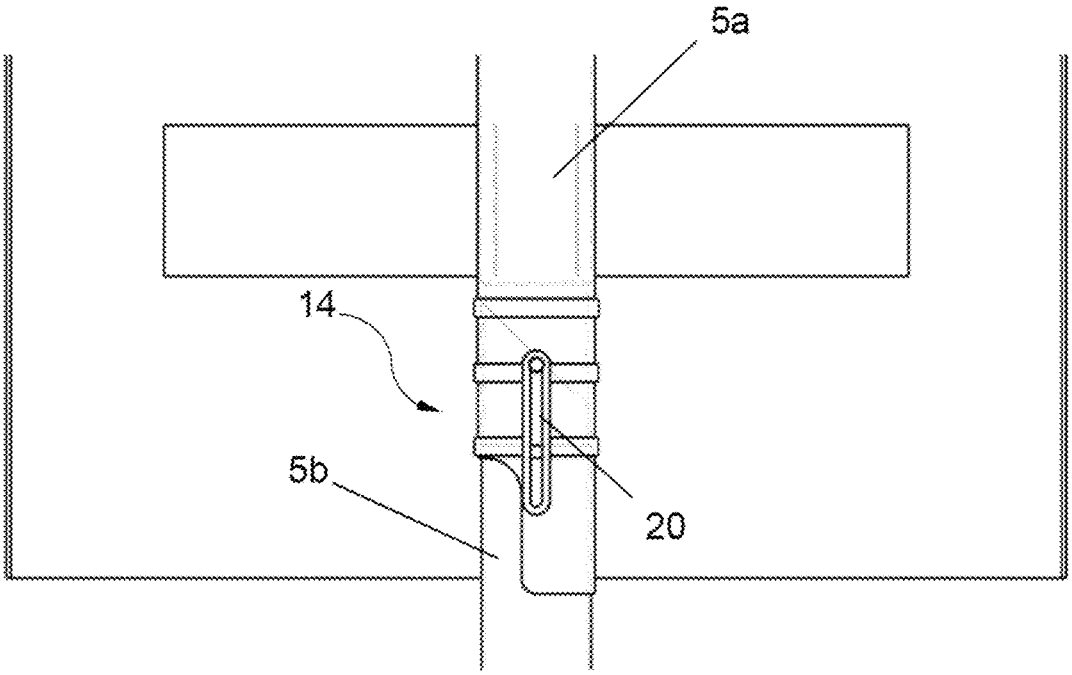
FIG. 8 illustrates a configuration of the geometry of a first part and a second part of the hinge joint in the subsea wellhead assembly.

FIGS. 6 to 8 illustrate further details of the hinge joint 14. As previously described, the hinge joint 14 is located at the interface between the first section 5*a* and the second section 5*b*. FIG. 6 illustrates the steps involved in configuring the connector pipe 5 from the compact configuration to the expanded configuration.

In FIG. 6, the conductor pipe 5 is show in the left in the compact configuration, and in this case, the first section 5*a* is axially offset approximately 90 degrees from the second section 5*b*. In the central of FIG. 6, the first and second sections 5*a*, 5*b* of the conductor pipe 5 have been moved to the extended configuration so that the first and second sections 5*a*, 5*b* are axially aligned and the conductor pipe 5 is now straight. A hinge pin mechanism 20 can also be seen in FIG. 6. With the hinge pin mechanism 20 holding the hinge joint 14 in a disengaged configuration, as is the case in the left and center of FIG. 6, the end of the first section 5*a* is held distal to the end of the second section 5*b*, and movement of the second section 5*b* relative to the first section 5*a* is possible. In the right of FIG. 6, which also shows the conductor pipe 5 in the extended configuration, the hinge pin mechanism 20 may be moved (in this example, moved in an upwards direction towards the first section 5*a* to the position illustrated by arrow A) to reconfigure the hinge joint 14 to the engaged configuration. In the engaged configuration, the hinge joint 14 may hold the end of the second section 5*b* proximate to the second section 5*a*, and in some examples, the end of the first section 5*a* may engage or abut the end of the second section 5*b*. The hinge pin mechanism 20 may be located on, or defined by, the second section 5*b*, and therefore movement of the hinge pin mechanism 20 towards the first part 5*a* may also have the effect of moving the second section 5*b* in the direction of the first section 5*a*, as illustrated by arrow B in FIG. 6. Movement of the second section 5*b* relative to the first section 5*a* may no longer be possible in the engaged configuration.

Once the conductor pipe 5 is in the expanded configuration and the hinge joint 5 is in the engaged configuration, the subsea foundation 1 may be ready to be installed in a subsea location. Having the conductor pipe 5 protruding from the lower component 12 may assist to provide an accurate and efficient installation of the subsea formation 1 in a desired position, and may assist to prevent washout during installation and subsequent drilling operations. Having a longer conductor pipe 5 may, for example, permit the conductor pipe 5 to reach a greater depth in a seabed, ocean floor, lakebed, or the like, where the earth may be harder and less prone to erosion, thereby preventing washout.

Further details of the hinge joint 14 and the geometry of the first and second parts 5*a*, 5*b* are shown in FIGS. 7 and 8. With the conductor pipe 5 in the compact configuration, as in FIG. 7, the hinge pin mechanism 20 can be seen to be in a lower position, and the ends of the first and second sections 5*a*, 5*b* are held distal to one another. With the hinge pin mechanism 20 in this position, movement of the second part 5*b* relative to the first part is possible without the end of the second part 5*b* coming into contact with the first part 5*a*.

The hinge pin mechanism 20 is in an upper position in FIG. 8. It can here be seen that the end of the first section 5*a* has been brought proximate to the end of the second section 5*b* so that the ends of the first and second sections 5*a*, 5*b* are in contact. Bringing the second section 5*b* into contact with the first section 5*a* may be achieved by using a lifting wire, or by compression of the second section 5*b* towards the first section 5*a* through use of the seabed. Although not illustrated, the hinge joint 14 may comprise a seal or sealing arrangement to facilitate fluid flow through the hinge joint without leakage thereof. By holding the first and second sections 5*a*, 5*b* in contact, a relative movement of the sections 5*a*, 5*b* is restricted or possibly completely prevented. With the hinge pin mechanism 20 in this position, the first section 5*a* may be considered to be locked in position relative to the second position.

Having such a subsea foundation 1 with a conductor pipe 5 comprising a first and second section 5*a*, 5*b*, the section 5*b* being pivotably connected to the first section 5*a* may allow a conductor pipe 5 that is longer, and with a greater possible diameter than other solutions. The diameter of the conductor pipe 5 may, for example, be able to be wider than in cases where the conductor pipe 5 is telescopic, thereby requiring a smaller diameter with each telescopic section. Having a pivotal connection may also be a simpler solution that is less prone to problems (e.g., sticking or excessive wear) than known solutions which may comprise many and/or complex moving parts.

The present invention is not limited by the embodiments described above; reference should be had to the appended claims.

LIST OF REFERENCE NUMERALS

1 Subsea foundation
2 Receptacle
3 Wellhead housing
5 Conductor pipe
5*a* First section
5*b* Second section
10 Upper component
12 Lower component/Suction anchor base
14 Hinge joint
16 Support member
18 Lower rim
20 Hinge pin mechanism

What is claimed is:

1. A subsea foundation for installation on a sea floor, the subsea foundation comprising:

a receptacle which is configured to receive a wellhead housing; and a conductor pipe which is arranged to extend from the receptacle and which is configured to receive a well pipe therethrough, the conductor pipe comprising, a first section comprising a first end and a second end, a second section, and a hinge joint arranged between the first section and the second section of the conductor pipe, the hinge joint being configured to enable a pivotal connection therebetween, wherein, the first section is connected to the receptacle at the first end and is pivotably connected to the second section at the second end via the hinge joint so that the conductor pipe is configurable between a compact configuration, in which the conductor pipe comprises a bend therein, and an extended configuration, in which the conductor pipe is substantially straight.

2. The subsea foundation as recited in claim 1, further comprising:

a suction anchor base.

3. The subsea foundation as recited in claim 1, wherein the hinge joint comprises a disengaged configuration in which an end of the second section is held distal to the second end of the first section and a pivotal movement therebetween is enabled, and an engaged configuration in which the second end of the first section is engaged with the end of the second section and the conductor pipe is in the extended configuration.

4. The subsea foundation as recited in claim 2, wherein, the suction anchor base is substantially cylindrical, and the first section of the conductor pipe is arranged concentrically inside the suction anchor base.

5. The subsea foundation as recited in claim 2, wherein the first section of the conductor pipe is arranged entirely within the suction anchor base.

6. The subsea foundation as recited in claim 2, wherein, the suction anchor base is cylindrical, and the second section of the conductor pipe is shorter than a radius of the suction anchor base so that, in the compact configuration, the second section of the conductor pipe is arranged inside the suction anchor base.

7. The subsea foundation as recited in claim 2, wherein, the suction anchor base is cylindrical and comprises a recess arranged therein, the second section of the conductor pipe is longer than a radius of the suction anchor base, and the recess of the suction anchor base is arranged to receive the second section when the conductor pipe in the compact configuration.

8. The subsea foundation as recited in claim 2, wherein, in the extended configuration, the conductor pipe protrudes outside the suction anchor base.

* * * * *